US006222435B1

(12) United States Patent
Bonnefoit

(10) Patent No.: US 6,222,435 B1
(45) **Date of Patent: *Apr. 24, 2001**

(54) STICK COIL FOR IGNTION SYSTEMS

(75) Inventor: Christian Bonnefoit, Martinszell (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/381,013

(22) PCT Filed: Sep. 25, 1999

(86) PCT No.: PCT/DE98/02855

§ 371 Date: Sep. 13, 1999

§ 102(e) Date: Sep. 13, 1999

(87) PCT Pub. No.: WO99/36693

PCT Pub. Date: Jul. 22, 1999

(30) Foreign Application Priority Data

Jan. 13, 1998 (DE) ..... 298 00 453

(51) Int. Cl.[7] ..... H01F 27/02; H01F 27/36

(52) U.S. Cl. ..... 336/90; 336/84 R; 336/96; 336/83

(58) Field of Search ..... 336/83, 96, 90, 336/234, 84 C, 84 R, 84 M; 123/634, 635

(56) References Cited

U.S. PATENT DOCUMENTS 5,144,935 * 9/1992 Taruya et al. ..... 123/633
5,703,556 * 12/1997 Kikuta et al. ..... 336/83

FOREIGN PATENT DOCUMENTS 39 15 113 11/1990 (DE) .
41 32 851 4/1992 (DE) .
57 193776 11/1982 (JP) .

* cited by examiner

*Primary Examiner*—Michael L. Gellner
*Assistant Examiner*—Anh Mai
(74) *Attorney, Agent, or Firm*—Kenyon & Kenyon

(57) ABSTRACT

A bar-type coil for ignition systems, in particular, for as an ignition coil in internal combustion engines of motor vehicles, is designed to minimize the interference voltage produced by the ignition processes. The bar-type coil has a core, designed as an I-core, a tubular magnetic return plate, and a primary terminal. Mounted in the primary terminal is, in addition to other elements, a first contact element, which is electrically connected to frame potential. The first contact element is part of a line bar, which is electrically connected via a resistance element or via a laminated strip to the tubular magnetic return plate, so that the interference voltage produced is diverted to frame potential. The bar-type coil may be used in automobile manufacturing.

6 Claims, 2 Drawing Sheets

STICK COIL FOR IGNTION SYSTEMS

BACKGROUND OF THE INVENTION

The present invention relates to a bar-type coil for ignition systems, in particular, a bar type coil for use as an ignition coil in internal combustion engines of motor vehicles according to the definition of the.

BACKGROUND INFORMATION

German Patent No. 41 32 851 describes a bar-type coil whose basic form is that of a cylindrical housing. Joined to the housing is a primary terminal having contact elements, which are electrically connected to winding ends of a coil assembly of the ignition coil arranged in the housing.

Disposed in a central position in the housing and within the coil assembly is a bar-shaped core of an open magnetic circuit. The coil assembly is concentrically surrounded by a longitudinally slotted magnetic return plate for directing the magnetic field.

During operation of the ignition coil, an interference energy is produced by an external partial discharging and acts, by way of capacitive re-charging processes, upon the primary terminal. The ignition-coil housing insulates the magnetic return plate from the spark plug shaft. The interference energy is dependent upon the electric field strength between the magnetic return plate and the spark plug shaft. Because of the installation location in the spark plug shaft, the interference energy is greater than in conventional ignition coils having a magnetic circuit that is closed over the core material.

The elevated interference energy, which may spread via the primary terminal and the lines connected thereto into the motor vehicle's electrical system, can cause unwanted degradations in the functions of other electrical components of the motor vehicle, such as a control unit or a radio receiver.

SUMMARY OF THE INVENTION

An advantage of a bar-type coil according to the present invention for ignition systems is that the deficiencies described above are avoided. This is achieved by configuring the bar-type coil with the magnetic return plate connected to the frame potential and diverting the charge carriers, which form and contribute to a partial discharging, to ground. This decreases the danger of malfunctions in electrical aggregates of the motor vehicle.

In certain cases, direct contact of the magnetic return plate with ground, leads to a voltage loss at the secondary side of the ignition coil carrying the high voltage. It is necessary to connect a resistance element having high enough resistance between the magnetic return plate and frame potential to avoid such a voltage loss.

DETAILED DESCRIPTION

Figure 1:
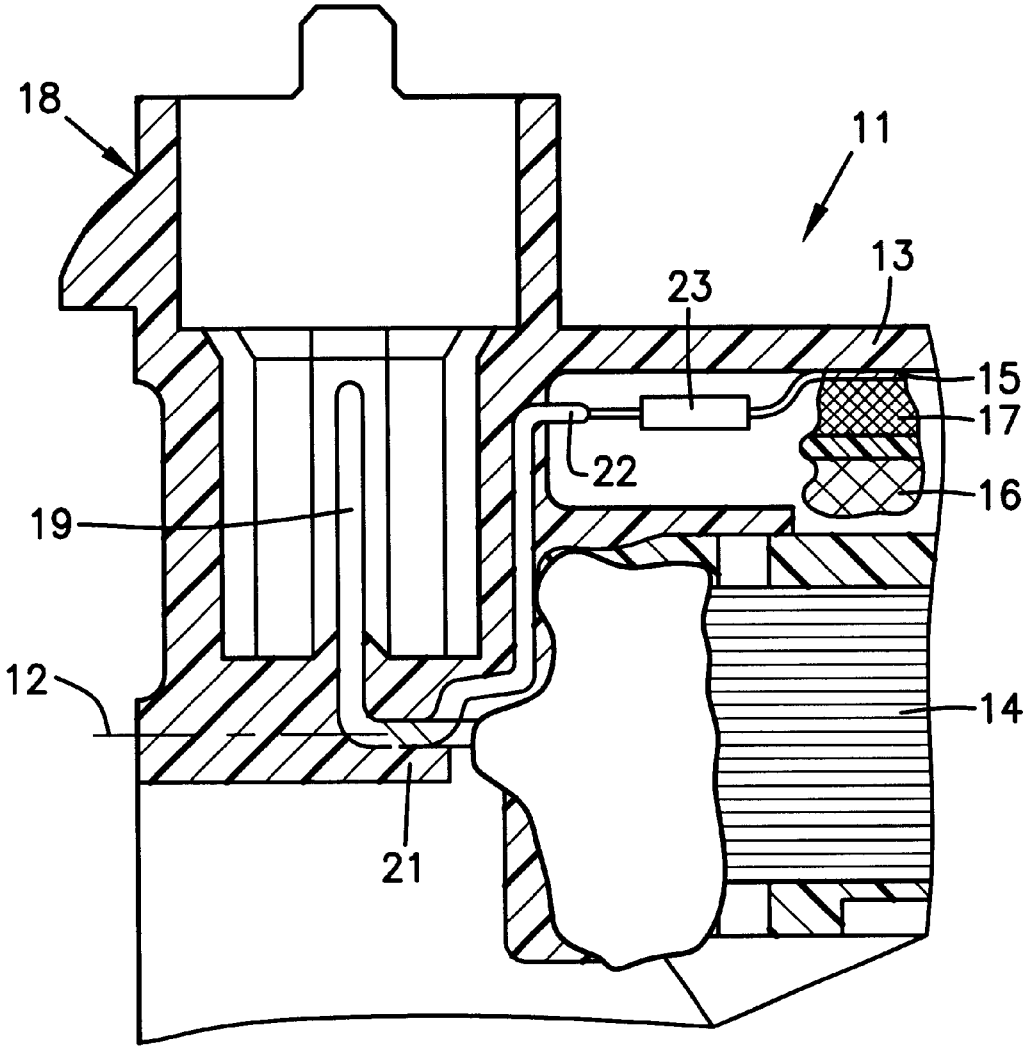
FIG. 1 illustrates a sectional view of a first embodiment of a bar-type coil for ignition systems according to the present invention.
Figure 2:
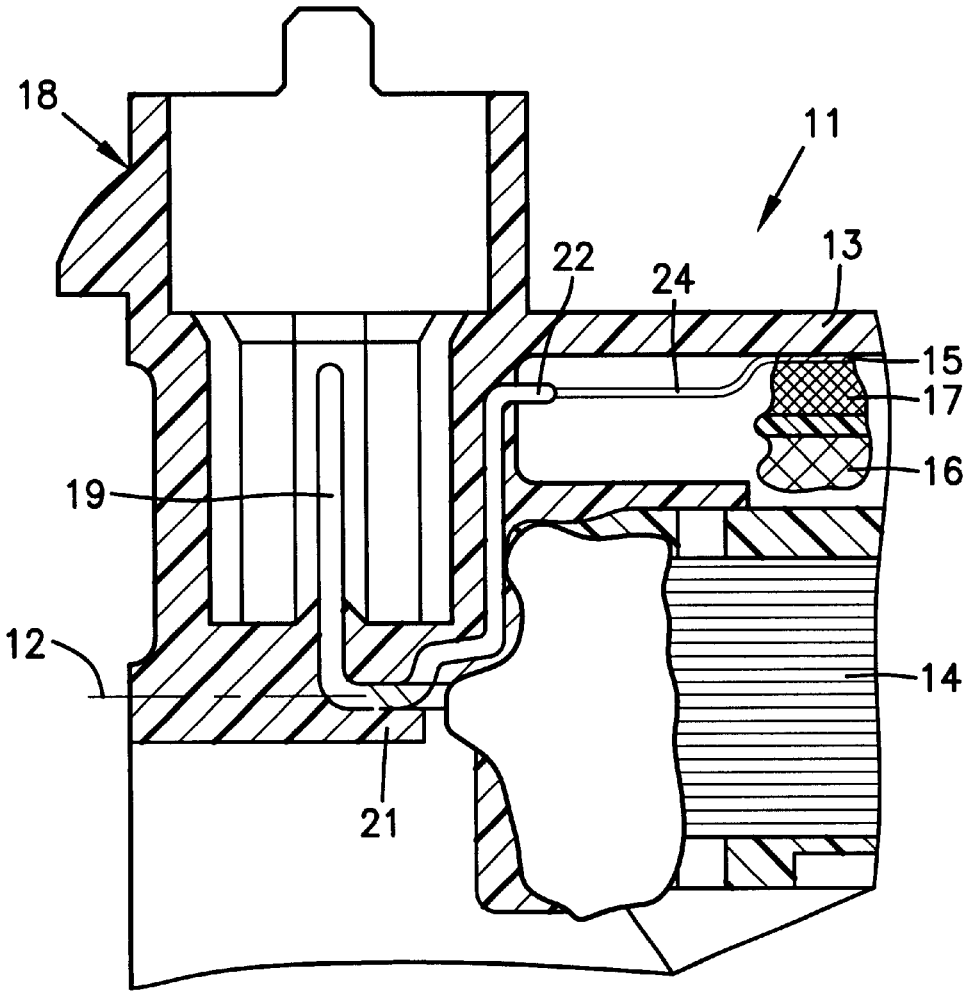
FIG. 2 illustrates a sectional view of a second embodiment of a bar-type coil for ignition systems according to the present invention.

According to FIGS. 1, and 2, a bar type coil 11 for ignition systems, in particular, a bar type coil for use as an ignition coil in internal combustion engines of motor vehicles, is provided with a spark plug to enable direct contacting. The spark plug is inserted in a customary manner (not shown) in a shaft of the cylinder head of an internal combustion engine.

Disposed in a housing 13 of plastic, co-axially to a longitudinal axis 12, bar-type coil 11 contains an elongated, cylindrical core 14, also referred to as an I-core. Core 14 is made of a layered magnetic material and constitutes part of an open magnetic circuit. Arranged concentrically around core 14 is an inner primary winding 16, which conducts a low voltage, and an outer secondary winding 17, which conducts a high voltage. To direct the magnetic field, windings 16, 17 are surrounded by a magnetic return plate 15, which is supported on the inside of housing 13. Magnetic return plate 15 is slotted in parallel to longitudinal axis 12 to prevent any short-circuiting of the magnetic field.

As part of a primary terminal 18 of bar-type coil 11, a plug-connector member is integrally, formed in one piece with housing 13 at one end of bar-type coil 11. Primary terminal 18 has, in addition to other elements, a first contact element 19, which is electrically connected to frame potential. This first contact element 19 is part of a line bar 21, which is formed as a laminated strip and, in the first exemplary embodiment illustrated in FIG. 1, is electrically connected by one unattached end 22 to a resistance element 23. Resistance element 23, in turn, is electrically connected to magnetic return plate 15.

If no resistance element 23 is necessary, a laminated strip 24 is then used instead as an electrical bridge, in accordance with the second exemplary embodiment illustrated in FIG. 2.

Resistance element 23, or laminated strip 24, has the effect of compensating for the charge carriers, so that no interference energy is produced in this case by an energy-rich partial discharging.

What is claimed is:

1. A bar-shaped coil for an ignition system of an internal combustion engine, comprising:

a housing; and an open magnetic circuit mounted inside the housing, the open magnetic circuit including an internal magnetic iron core and an outer magnetic iron core, the outer magnetic iron core being a magnetic return plate, the magnetic return plate electrically coupled to a frame potential.

2. The bar-shaped coil according to claim 1, wherein the magnetic return plate is electrically coupled to the frame potential via one of a resistance element and an electrical bridge.

3. The bar-shaped coil according to claim 2, wherein the electrical bridge is a laminated strip.

4. The bar-shaped coil according to claim 3, further comprising:

a primary terminal mounted on the housing, the primary terminal having at least a first and a second contact element supplying a low voltage, the first contact element being electrically coupled to the frame potential and the magnetic return plate.

5. The bar-shaped coil according to claim 4, wherein the first contact element is part of a line bar.

6. The bar-shaped coil according to claim 5, wherein the internal magnetic iron core is a rod-shaped I-core made of a layered material, and the magnetic return plate is tubular-shaped.

* * * * *

UNITED STATES PATENT AND TRADEMARK OFFICE

CERTIFICATE OF CORRECTION

PATENT NO. : 6,222,435 B1
DATED : April 24, 2001
INVENTOR(S) : Christian Bonnefoit It is certified that error appears in the above-identified patent and that said Letters Patent is hereby corrected as shown below:

Title page,
Item [54], change the title to read -- BAR-TYPE COIL FOR IGNITION SYSTEMS --;
Item [57], ABSTRACT,
Line 1, change "for as an" to -- for use as an --;

Column 1,
Line 7, change "vehicles" to -- vehicles. --;
Line 8, delete "according to the definition of the.";

Column 2,
Line 19, change "integrally," to -- integrally --.

Signed and Sealed this

Tenth Day of December, 2002

JAMES E. ROGAN
*Director of the United States Patent and Trademark Office*